US009008566B2

(12) United States Patent
Lu et al.

(10) Patent No.: US 9,008,566 B2
(45) Date of Patent: Apr. 14, 2015

(54) IMAGE FORMING DEVICE

(71) Applicant: KYOCERA Document Solutions Inc., Osaka (JP)

(72) Inventors: Lin Lu, Osaka (JP); Masayuki Yamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/090,607

(22) Filed: Nov. 26, 2013

(65) Prior Publication Data

US 2014/0147138 A1 May 29, 2014

(30) Foreign Application Priority Data

Nov. 29, 2012 (JP) ..... 2012-261146
Dec. 20, 2012 (JP) ..... 2012-278504

(51) Int. Cl.
*G03G 15/00* (2006.01)
*G03G 15/16* (2006.01)

(52) U.S. Cl.
CPC .... *G03G 15/1605* (2013.01); *G03G 2215/0132* (2013.01); *G03G 15/657* (2013.01); *G03G 2215/00649* (2013.01)

(58) Field of Classification Search
CPC ..... G03G 15/0132; G03G 15/657; G03G 2215/00649; G03G 2215/0132
See application file for complete search history.

(56) References Cited

U.S. PATENT DOCUMENTS

| | | | | |
|---|---|---|---|---|
| 6,289,199 | B1 * | 9/2001 | Fujiwara | 399/398 |
| 8,135,319 | B2 * | 3/2012 | Fujita | 399/316 |
| 2007/0104502 | A1 * | 5/2007 | Ogihara et al. | 399/66 |
| 2011/0103850 | A1 * | 5/2011 | Watanabe et al. | 399/315 |
| 2012/0189330 | A1 * | 7/2012 | Kunimatsu et al. | 399/44 |
| 2014/0064761 | A1 * | 3/2014 | Hayashi | 399/66 |

FOREIGN PATENT DOCUMENTS

| | | |
|---|---|---|
| JP | 2006-251664 | 9/2006 |
| JP | 2009-251126 | 10/2009 |

* cited by examiner

*Primary Examiner* — Clayton E Laballe
*Assistant Examiner* — Ruifeng Pu
(74) *Attorney, Agent, or Firm* — Wenderoth, Lind & Ponack, L.L.P.

(57) ABSTRACT

An image forming device includes: a secondary transfer roller configured to secondarily transfer a toner image transferred to an intermediate transfer belt, to a transfer paper; separating plates; and a power supply circuit configured to apply bias voltages to the separating plates. The separating plates are configured to separate the transfer paper from the intermediate transfer belt when the bias voltages are applied to the separating plates. The separating plates include two or more separating plates installed along a direction perpendicular to the transfer paper conveying direction. The bias voltages are applied to the separating plates independently of each other depending on a toner amount distribution of the toner image transferred to the transfer paper, in the direction perpendicular to the transfer paper conveying direction.

3 Claims, 5 Drawing Sheets

IMAGE FORMING DEVICE

CROSS-REFERENCE TO RELATED APPLICATION(S)

This application is based upon and claims the benefit of priority from Japanese Patent Application(s) No. 2012-261146 filed on Nov. 29, 2012 and No. 2012-278504 filed on Dec. 20, 2012, the entire contents of which are incorporated herein by reference.

BACKGROUND

The technology of the present disclosure relates to an image forming device and, more particularly, to an image forming device that includes an intermediate transfer body to which a toner image formed in an image carrier is firstly transferred and a secondary transfer member for secondarily transferring the toner image transferred to the intermediate transfer body to a recording medium.

In general, there is known an image forming device that includes an image carrier such as a photosensitive body or the like, on the surface of which a toner image is formed, an intermediate transfer belt (intermediate transfer body) which rotates in synchronization with the image carrier and to which the toner image formed in the image carrier is firstly transferred, and a secondary transfer roller (secondary transfer member) for secondarily transferring the toner image transferred to the intermediate transfer belt to a transfer paper (recording medium). The image forming device is configured to separate the transfer paper from the intermediate transfer belt and to convey the transfer paper to a fixing unit.

In the image forming device, it is sometimes the case that the secondarily-transferred transfer paper is not separated from the intermediate transfer belt but is stuck to the intermediate transfer belt, consequently generating a paper jam phenomenon. In order to improve this phenomenon, there is extensively used a method in which a separating member from separating a transfer paper from an intermediate transfer belt is installed at the downstream side of a nip portion between the intermediate transfer belt and the secondary transfer roller in a transfer paper conveying direction. In this method, the transfer paper is separated from the intermediate transfer belt by removing electricity from the transfer paper with the separating member.

There is also known an image forming device in which a photo sensor for detecting the kind of a transfer paper is installed and in which the position of a separating member is changed depending on the kind of a transfer paper. In this image forming device, the sticking of a transfer paper to an intermediate transfer belt is restrained by setting an electricity removal amount depending on the kind of a transfer paper.

SUMMARY

An image forming device according to one aspect of the present disclosure includes an image carrier, an intermediate transfer body, a secondary transfer member, separating members and a power supply circuit. The image carrier has a surface on which a toner image is formed. The toner image formed on the image carrier is firstly transferred the intermediate transfer body. The secondary transfer member is arranged to make contact with the intermediate transfer body and is configured to secondarily transfer the toner image transferred to the intermediate transfer body, to a recording medium. The separating members are arranged at a downstream side of a nip portion between the intermediate transfer body and the secondary transfer member in a recording medium conveying direction and are configured to separate the recording medium from the intermediate transfer body. The power supply circuit is configured to apply bias voltages to the separating members. The separating members are configured to separate the recording medium from the intermediate transfer body when the bias voltages are applied to the separating members. The separating members include two or more separating members installed along a direction perpendicular to the recording medium conveying direction. The bias voltages are applied to the separating members independently of each other.

DETAILED DESCRIPTION

Figure 1:
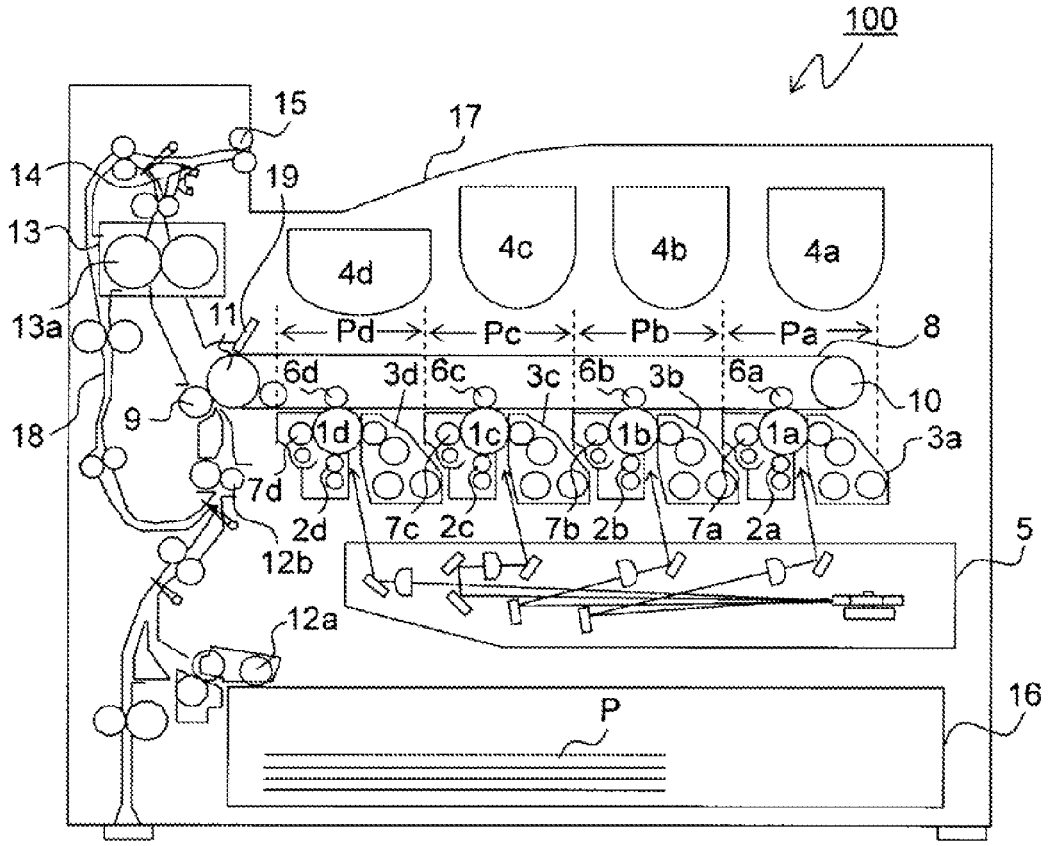
FIG. 1 is a section view schematically showing a structure of an image forming device according to a first embodiment.

Certain embodiments will now be described with reference to the drawings.

<<First Embodiment>>

A structure of an image forming device 100 according to the present embodiment will be described with reference to FIGS. 1 to 3. Within a main body of an image forming device 100 (a color printer in the present embodiment), four image forming units Pa, Pb, Pc and Pd are arranged in the named order from the upstream side in a conveying direction (from the right side in FIG. 1). The image forming units Pa to Pd are installed in a corresponding relationship with images of four different colors (cyan, magenta, yellow and black) and are configured to sequentially form cyan, magenta, yellow and black images through electrification, exposure, development and transfer processes.

Photosensitive drums (image carriers) 1*a*, 1*b*, 1*c* and 1*d* which carry visible images (toner images) of different colors are arranged in the respective image forming units Pa to Pd. In the image forming units Pa to Pd, an intermediate transfer belt (intermediate transfer body) 8 rotated clockwise in FIG. 1 by a drive means (not shown) is installed adjacent to the respective image forming units Pa to Pd. Toner images formed on the photosensitive drums 1*a* to 1*d* are firstly transferred one after another onto the intermediate transfer belt 8 which moves while making contact with the respective photosensitive drums 1*a* to 1*d*. Thus, the toner images are superimposed one above another. Thereafter, the toner images firstly transferred onto the intermediate transfer belt 8 are secondarily transferred onto a transfer paper P, one example of a recording medium, under the action of a secondary transfer roller (secondary transfer member) 9. The transfer paper P, to which the toner images have been secondarily transferred, is discharged from the main body of the image forming device 100 after the toner images are fixed in a fixing unit 13. Image forming processes are performed with respect to the respective photosensitive drums 1*a* to 1*d* while rotating the photosensitive drums 1*a* to 1*d* counterclockwise in FIG. 1.

The transfer paper P, to which the toner images are to be transferred, is held within a paper cassette 16 arranged below the main body of the image forming device 100. The transfer paper P is conveyed to a nip portion between the secondary transfer roller 9 and the intermediate transfer belt 8 via a paper feeding roller 12*a* and a register roller pair 12*b*. A sheet made of a dielectric resin is used as the intermediate transfer belt 8. In particular, a belt having no seam (a seamless belt) is primarily used as the intermediate transfer belt 8. A blade-shaped belt cleaner 19 for removing toner or the like remaining on the surface of the intermediate transfer belt 8 is arranged at the downstream side of the secondary transfer roller 9.

Next, description will be made on the image forming units Pa to Pd. Around and below the rotatably-installed photosensitive drums 1*a* to 1*d*, there are arranged electrifiers 2*a*, 2*b*, 2*c* and 2*d* for electrifying the photosensitive drums 1*a* to 1*d*, an exposure unit 5 for exposing image information to the respective photosensitive drums 1*a* to 1*d*, developing units 3*a*, 3*b*, 3*c* and 3*d*for forming toner images on the photosensitive drums 1*a* to 1*d*, and cleaning units 7*a*, 7*b*, 7*c* and 7*d* for removing developing agents (toner) remaining on the photosensitive drums 1*a* to 1*d*.

If image data are inputted from an upper device such as a personal computer or the like, the surfaces of the photosensitive drums 1*a* to 1*d* are uniformly electrified by the electrifiers 2*a* to 2*d*. Subsequently, the exposure unit 5 irradiates light in conformity with the image data, thereby forming electrostatic latent images corresponding to the image data on the respective photosensitive drums 1*a* to 1*d*. Two-component developers containing toner of different colors, i.e., cyan, magenta, yellow and black, are filled into the developing units 3*a* to 3*d* in a specified amount. If the percentage of the toner in the two-component developers filled into the respective developing units 3*a* to 3*d* is reduced to below a prescribed value due to the formation of the toner images to be described later, toner are refilled from toner containers (refilling units) 4*a* to 4*d* to the respective developing units 3*a* to 3*d*. The toner existing in the developers are supplied onto the photosensitive drums la to 1 d by the developing units 3a to 3d. The toner electrostatically adhere to the photosensitive drums 1*a* to 1*d*. Thus, toner images corresponding to the electrostatic latent images formed by the exposure in the exposure unit 5 are formed in the photosensitive drums 1*a* to 1*d*.

Then, primary transfer rollers 6*a* to 6*d* apply electric fields to between the primary transfer rollers 6*a* to 6*d* and the photosensitive drums 1*a* to 1*d* at a specified transfer voltage. Thus, the cyan, magenta, yellow and black toner images of the photosensitive drums 1*a* to 1*d* are firstly transferred onto the intermediate transfer belt 8. These four-color images are formed in a specified positional relationship which is determined in advance for the formation of a full-color image. Thereafter, in preparation for the subsequent formation of new electrostatic latent images, the toner or the like remaining on the surfaces of the photosensitive drums 1*a* to 1*d* after the first transfer are removed by the cleaning units 7*a* to 7*d*.

The intermediate transfer belt 8 is stretched between an upstream-side driven roller 10 and a downstream-side driving roller 11. If the intermediate transfer belt 8 begins to rotate clockwise along with the rotation of the driving roller 11 caused by a driving motor (not shown), the transfer paper P is conveyed from the register roller pair 12*b* to a nip portion (secondary transfer nip portion) between the intermediate transfer belt 8 and the secondary transfer roller 9 adjacent thereto at a specified timing. Then, the full-color image of the intermediate transfer belt 8 is secondarily transferred onto the transfer paper P. The transfer paper P, to which the toner images have been secondarily transferred, is conveyed to the fixing unit 13.

The transfer paper P conveyed to the fixing unit 13 is heated and pressed by a fixing roller pair 13*a*, whereby the toner images are fixed to the surface of the transfer paper P. Thus, a specified full-color image is formed on the transfer paper P. The conveying direction of the transfer paper P, on which the full-color image has been formed, is diverted by a branch unit 14 branched in different directions. If an image is formed on only one surface of the transfer paper P, the transfer paper P is directly discharged to the discharge tray 17 by a discharging roller pair 15.

On the other hand, if images are formed on the opposite surfaces of the transfer paper P, a portion of the transfer paper P passed through the fixing unit 13 is first caused to protrude from the discharging roller pair 15 to the outside of the device. Then, after the rear end of the transfer paper P passes through the branch unit 14, the discharging roller pair 15 is rotated in the reverse direction and the conveying direction of the branch unit 14 is changed over. Thus, the rear end of the transfer paper P is diverted to a paper conveying path 18. The transfer paper P is conveyed again to the secondary transfer nip portion with the image surface thereof inverted. Then, the next toner images formed on the intermediate transfer belt 8 are secondarily transferred by the secondary transfer roller 9 to the surface of the transfer paper P on which an image is not formed. The transfer paper P, to which the toner images have been secondarily transferred, is conveyed to the fixing unit 13 where the toner images are fixed. Thereafter, the transfer paper P is discharged to the discharge tray 17.

Next, the detailed structure around the secondary transfer nip portion will be described with reference to FIGS. 2 and 3. FIG. 2 is a view seen from the rear side in FIG. 1. The arrangement of the respective members in FIG. 2 is the left-right reverse of the arrangement of the respective members in FIG. 1.

Figure 2:
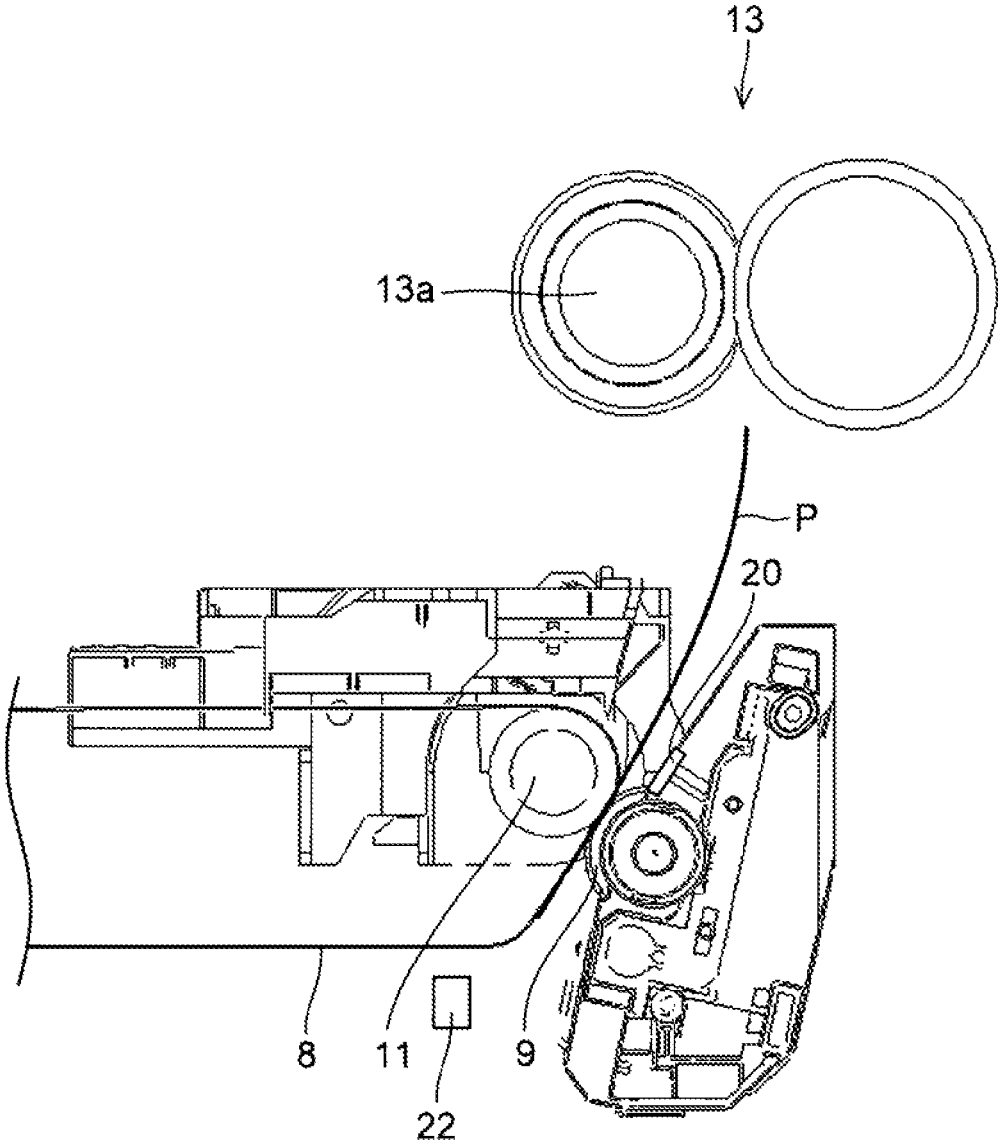
FIG. 2 is a section view showing a structure around a secondary transfer nip portion according to the first embodiment.

As shown in FIG. 2, the secondary transfer roller 9 is pressed against the driving roller 11 with the intermediate transfer belt 8 interposed therebetween. Metal-made separating plates (separating members) 20 for separating the transfer paper P from the intermediate transfer belt 8 are arranged at the downstream side (the upper side in FIG. 2) of the nip portion (secondary transfer nip portion) between the intermediate transfer belt 8 and the secondary transfer roller 9 in the transfer paper conveying direction (recording medium conveying direction).

The separating plates 20 are arranged at the same side as the secondary transfer roller 9 with respect to the passing position of the transfer paper P and are positioned above the secondary transfer roller 9. A bias voltage is applied to the separating plates 20, thereby generating electric fields around the separating plates 20. Since the transfer paper P passed through the secondary transfer nip portion is electrified at a specified electric potential, a force pulling the transfer paper P toward the secondary transfer roller 9 is generated by the electric fields generated around the separating plates 20. As a result, the transfer paper P is separated from the intermediate transfer belt 8. If the bias voltage applied to the separating plates 20 is increased, the force pulling the transfer paper P becomes stronger.

Figure 3:
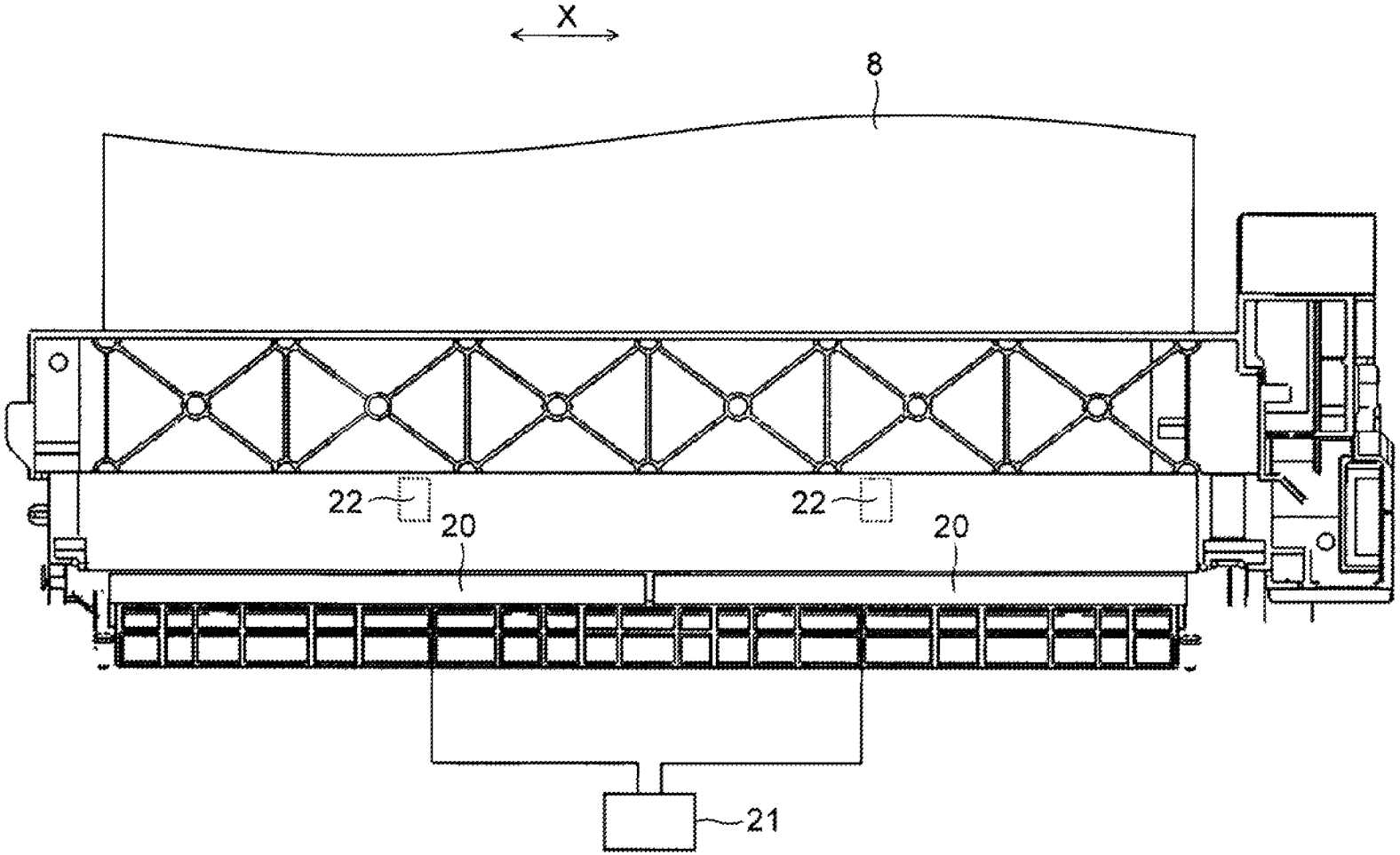
FIG. 3 is a top view showing the structure around the secondary transfer nip portion according to the first embodiment.

As shown in FIG. 3, two or more separating plates 20 (two separating plates 20 in the present embodiment) are installed along the direction perpendicular to the transfer paper conveying direction (along the extension direction of the secondary transfer roller 9) (the X-direction). A power supply circuit 21 is connected to the separating plates 20. The power supply circuit 21 can individually control the bias voltages applied to the separating plates 20. The bias voltages are applied to the respective separating plates 20 independently of each other.

As shown in FIG. 2, sensors 22 are installed at the upstream side (the lower side in FIG. 2) of the secondary transfer nip portion in the transfer paper conveying direction. The sensors 22 detect the toner amounts of the toner images transferred to the transfer paper P, at one side and the other side in the direction perpendicular to the transfer paper conveying direction (in the X-direction). More specifically, the sensors 22 are arranged below the intermediate transfer belt 8. Two or more sensors 22 (two sensors 22 in the present embodiment) are installed along the direction perpendicular to the transfer paper conveying direction (along the X-direction). That is to say, as shown in FIG. 3, the sensors 22 are installed in one-to-one correspondence to the respective separating plates 20.

The sensors 22 detect a toner amount per specified area by detecting the toner concentration of the toner images transferred to the intermediate transfer belt 8. More specifically, the sensors 22 irradiate measurement light on the toner images transferred to the intermediate transfer belt 8 and detect the amount of the light reflected from the toner images. Optical sensors, each of which includes a light emitting element formed of LEDs and a light receiving element formed of photo diodes, are ordinarily used as the sensors 22. If the toner amount is large, the light reflected from the belt surface is cut off by the toner. Thus, the light receiving amount of the light receiving element becomes smaller. On the other hand, if the toner amount is small, the light reflected from the belt surface is increased. As a consequence, the light receiving amount of the light receiving element becomes larger. The sensors 22 are concentration sensors for performing concentration correction and color deviation correction with respect to the toner images transferred to the intermediate transfer belt 8 and are also mounted to the well-known image forming devices.

The sensors 22 are arranged at a specified interval in the X-direction. The sensors 22 are positioned in the opposite end portions of the passing region of the transfer paper P having a smallest size (e.g., an A5R size) among the regular size papers used in the image forming device 100. This makes it possible to detect the toner amounts at two locations in the X-direction with respect to the transfer paper P having, e.g., a size ranging from an A3 size to A5R size.

The respective sensors 22 detect the toner concentrations of the toner images transferred to the intermediate transfer belt 8 and output detection signals corresponding to the toner amounts calculated from the detection results to a control unit (not shown). Thus, the control unit controls the output of the power supply circuit 21 so that there is no difference in the conveying speeds of the transfer paper P at the opposite sides in the X-direction. In this manner, the bias voltages applied to the separating plates 20 are controlled depending on the outputs of the sensors 22.

For example, if the toner amount of the toner images is large at one side in the X-direction, the X-direction one-side portion of the transfer paper P becomes hard to be separated from the intermediate transfer belt 8. Therefore, the power supply circuit 21 is controlled in such a way that the bias voltage applied to the X-direction one-side separating plate 20 becomes larger. This restrains the deflection of the transfer paper P toward the intermediate transfer belt 8 at one side in the X-direction. If the toner amount of the toner images is small at one side in the X-direction, the X-direction one-side portion of the transfer paper P becomes easy to be separated from the intermediate transfer belt 8 and becomes easy to be deflected toward the separating plate 20. Therefore, the power supply circuit 21 is controlled in such a way that the bias voltage applied to the X-direction one-side separating plate 20 becomes smaller. This restrains the deflection of the transfer paper P toward the secondary transfer roller 9 at one side in the X-direction. This holds true at the other side in the X-direction. The difference in the conveying speeds of the transfer paper P at one side and the other side in the X-direction is reduced by controlling the deflections of the transfer paper P at one side and the other side in the X-direction.

In the present embodiment, as described above, two or more separating plates 20 are installed along the direction perpendicular to the transfer paper conveying direction (along the X-direction). Bias voltages are applied to the respective separating plates 20 independently of each other. This makes it possible to adjust the bias voltages applied to one side and the other side in the X-direction. It is therefore possible to adjust the conveying speeds of the transfer paper P at one side and the other side in the X-direction. Accordingly, it becomes possible to restrain oblique motion of the transfer paper P and occurrence of jam in the section from the secondary transfer nip portion to the fixing unit 13. The difficulty to separate the transfer paper P from the intermediate transfer belt 8 and the conveying speed of the transfer paper P are changed depending on the toner amount of the toner images transferred to the transfer paper P. Therefore, the conveying speeds of the transfer paper P at one side and the other side can be appropriately adjusted by applying the bias voltages to the respective separating plates 20 independently of each other depending on the toner amounts at one side and the other side in the aforementioned manner. As a result, it is possible to easily restrain oblique motion of the transfer paper P and occurrence of jam in the section from the secondary transfer nip portion to the fixing unit 13.

The toner amounts at one side and the other side in the X-direction can be easily detected by installing the sensors 22 for the detection of the toner amounts at one side and the other side in the X-direction as described above. Oblique motion of the transfer paper P and occurrence of jam can be easily restrained by controlling the bias voltages applied to the respective separating plates 20 depending on the outputs of the sensors 22.

As set forth above, the sensors 22 detect the toner concentrations of the toner images and calculate the toner amounts based on the detection results. Thus, the sensors 22 can accurately detect the X-direction toner distribution in the toner images.

As mentioned earlier, the sensors 22 are concentration sensors for performing concentration correction and color deviation correction with respect to the toner images transferred to the intermediate transfer belt 8. Thus, the toner amounts can be detected by the existing concentration sensors (the sensors 22). This eliminates the need to additionally install sensors for detecting the toner amounts.

<<Second Embodiment>>

Figure 4:
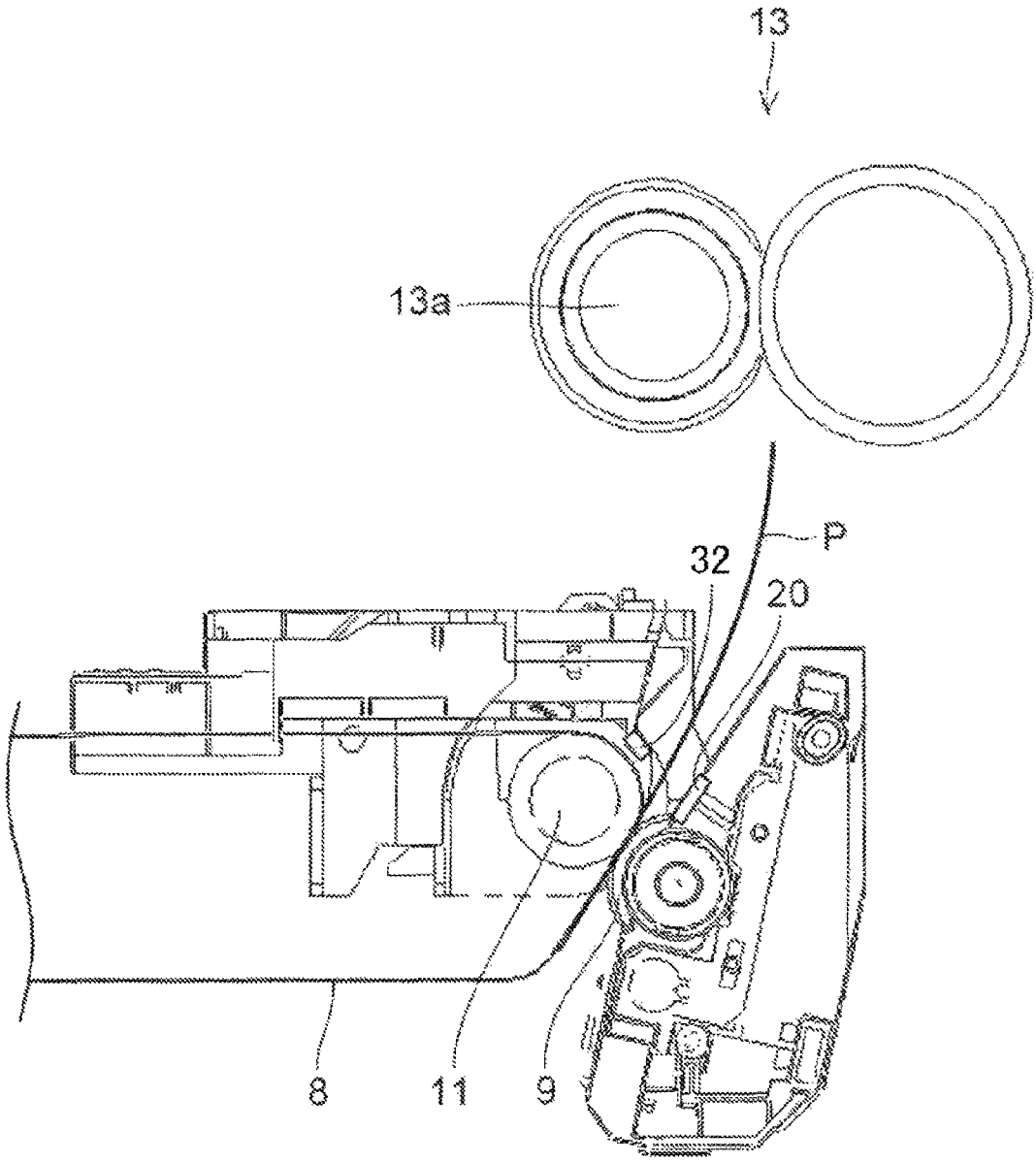
FIG. 4 is a section view showing a structure around a secondary transfer nip portion according to a second embodiment.
Figure 5:
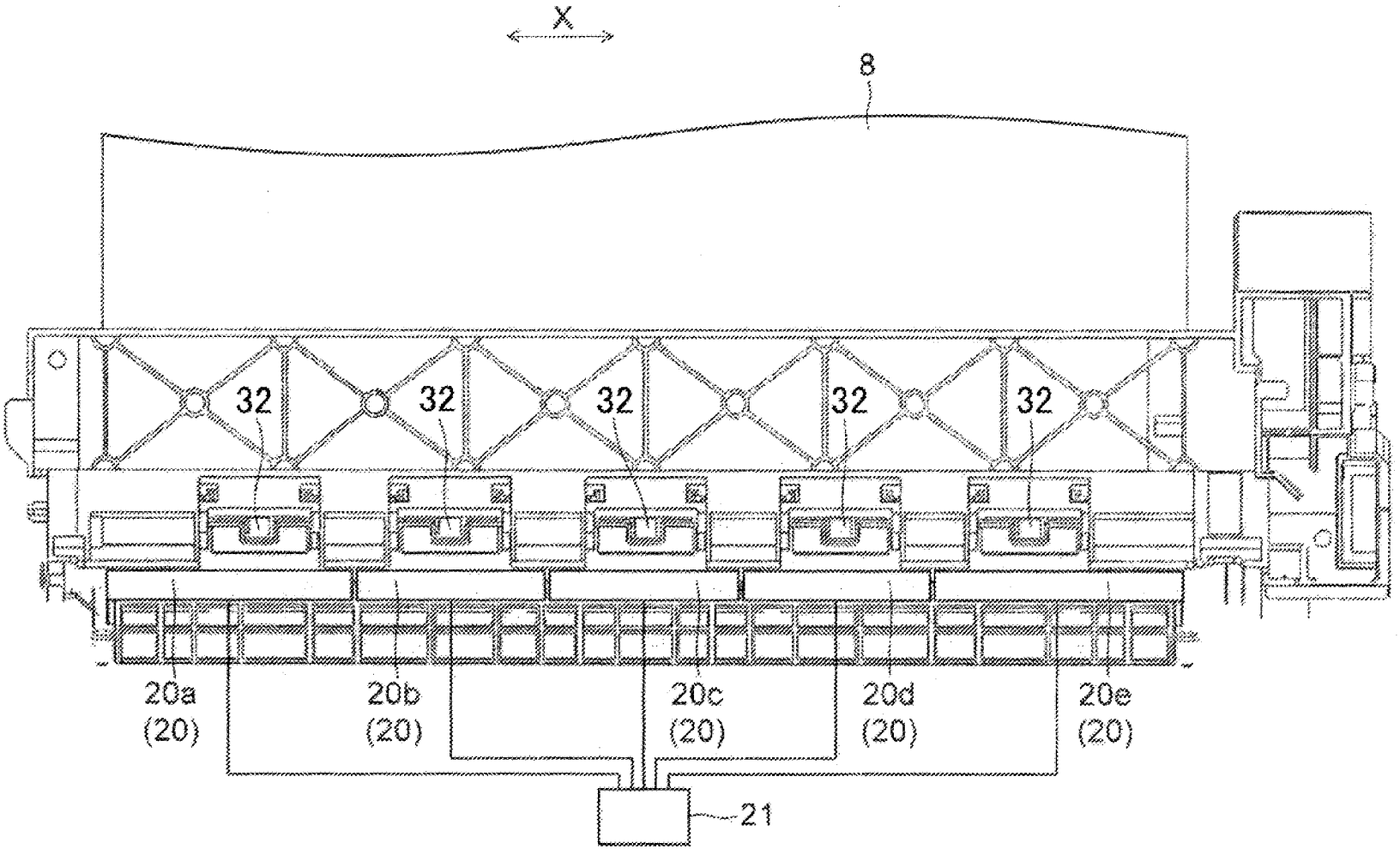
FIG. 5 is a top view showing the structure around the secondary transfer nip portion according to the second embodiment.

FIGS. 4 and 5 show a second embodiment. In the second embodiment, as shown in FIG. 4, deflection sensors 32 for detecting the deflections of the transfer paper P are installed at the downstream side (the upper side in FIG. 4) of the secondary transfer nip portion in the transfer paper conveying direction. The deflection sensors 32 are, e.g., optical reflection-type sensors. Each of the deflection sensors 32 includes a light emitting part and a light receiving part. For example, the light emitted from the light emitting part is reflected by the transfer paper P and is incident on the light receiving part. The deflection sensors 32 detect the deflections of the transfer paper P depending on the amount of the reflected light. The deflection sensors 32 are arranged at the same side as the intermediate transfer belt 8 with respect to the passing position of the transfer paper P and are positioned above the intermediate transfer belt 8.

As shown in FIG. 5, two or more deflection sensors 32 (five deflection sensors 32 in the present embodiment) are installed along the direction perpendicular to the transfer paper conveying direction (along the X-direction) in one-to-one correspondence to the respective separating plates 20. The respective deflection sensors 32 detect the deflections of the transfer paper P (the distances to the transfer paper P). Then, the respective deflection sensors 32 output detection signals corresponding to the detected deflections (distances) to a control unit (not shown). Thus, the control unit controls the output of the power supply circuit 21 so that there is no difference in the conveying speeds of the transfer paper P at the opposite sides in the X-direction. In this manner, the bias voltages applied to the separating plates 20 are controlled depending on the outputs of the deflection sensors 32.

For example, if the transfer paper P is deflected toward the intermediate transfer belt 8 at one side in the X-direction, the power supply circuit 21 is controlled in such a way that the bias voltage applied to the X-direction one-side separating plate 20 becomes larger. This restrains the deflection of the transfer paper P toward the intermediate transfer belt 8 at one side in the X-direction. If the transfer paper P is deflected toward the secondary transfer roller 9 at one side in the X-direction, the power supply circuit 21 is controlled in such a way that the bias voltage applied to the X-direction one-side separating plate 20 becomes smaller. This restrains the deflection of the transfer paper P toward the secondary transfer roller 9 at one side in the X-direction. This holds true at the other side in the X-direction.

The bias voltages can be applied to all the separating plates 20. Depending on the size of the transfer paper P, the bias voltages may be applied to minimum necessary separating plates 20. More specifically, the separating plates 20 include separating plates 20*a*, 20*b*, 20*c*, 20*d* and 20*e* sequentially arranged from one side (the left side in FIG. 5) to the other side (the right side in FIG. 5) in the X-direction. If the transfer paper P has such a small size as to pass through only a region extending from the separating plate 20*b* to the separating plate 20*d*, the bias voltages may be applied to only the separating plates 20*b* and 20*d* (the separating plates 20 through which the X-direction opposite end portions of the transfer paper P pass). In other words, the bias voltages may not be applied to the separating plates 20*a* and 20*e* (the separating plates 20 through which the transfer paper P does not pass). If necessary, a minimum necessary bias voltage for preventing the transfer paper P from sticking to the secondary transfer roller 9 may be applied to the separating plate 20*c*.

If the transfer paper P has such a large size as to pass through a region extending from the separating plate 20*a* to the separating plate 20*e*, the bias voltages may be applied to only the separating plates 20*a* and 20*e* (the separating plates 20 through which the X-direction opposite end portions of the transfer paper P pass). If necessary, a minimum necessary bias voltage for preventing the transfer paper P from sticking to the secondary transfer roller 9 may be applied to the separating plates 20*b*, 20*c* and 20*d*.

In the present embodiment, as described above, two or more separating plates 20 are installed along the direction perpendicular to the transfer paper conveying direction (along the X-direction). Bias voltages are applied to the respective separating plates 20 independently of each other. This makes it possible to adjust the bias voltages applied to one side and the other side in the X-direction. It is therefore possible to adjust the conveying speeds of the transfer paper P at one side and the other side in the X-direction. Accordingly, it becomes possible to restrain oblique motion of the transfer paper P and occurrence of jam in the section from the secondary transfer nip portion to the fixing unit 13.

By using the deflection sensors 32 as described above, it is possible to easily detect the conveying speeds of the transfer paper P at one side and the other side in the X-direction. By controlling the bias voltages applied to the respective separating plates 20 depending on the outputs of the deflection sensors 32, it is possible to easily restrain oblique motion of the transfer paper P and occurrence of jam.

If the bias voltages are applied to minimum necessary separating plates 20 depending on the size of the transfer paper P as described above, it is possible to reduce power consumption and to simplify bias voltage control.

It should be appreciated that the embodiments disclosed herein are not limitative but illustrative in all respects. The technical scope of the present disclosure is not defined by the above description of the embodiments but by the claims. All the modifications made within the meaning and scope equivalent to the claims are included in the technical scope of the present disclosure.

For example, while the tandem-type color image forming device shown in FIG. 1 has been described above, the technology of the present disclosure is not limited thereto. Needless to say, the technology of the present disclosure can be applied to many different image forming devices which include an intermediate transfer body and a secondary transfer member, such as a monochromatic copier, a monochromatic printer, a digital composite machine and a facsimile.

While an example in which the intermediate transfer belt is used as the intermediate transfer body has been described in the aforementioned embodiments, the technology of the present disclosure is not limited thereto. It may be possible to use, e.g., a drum-shaped intermediate transfer body.

While an example which makes use of the sensors 22 for detecting the toner concentrations of the toner images transferred to the intermediate transfer belt has been described in the first embodiment, the technology of the present disclosure is not limited thereto. Alternatively, printing rates at one side and the other side of the toner images transferred to the transfer paper may be calculated from the image data used in the exposure process. Then, the toner amount distribution in the X-direction may be calculated based on the printing rates. In this case, as compared with the method which makes use of the sensors 22, the calculated toner amounts may somewhat differ from the actual toner amounts. However, it is possible to easily detect the toner amounts over a wide region.

While an example in which two separating members are installed has been described in the aforementioned first embodiment, four or more separating members may be installed along the direction perpendicular to the transfer paper conveying direction. In this case, the same number of sensors as the separating members may be installed. In case where the toner amounts are derived (calculated) from the image data, there is no need to increase the number of sensors. Therefore, if four or more separating members are installed, it is preferable to use the method of deriving the toner amounts from the image data. In addition, the toner amounts may be calculated from the image data in case of an image having a size unreadable by the sensors, e.g., a postcard size. The toner amounts may be calculated from the detection results of the sensors in case of an image readable by the sensors. In this manner, it may be possible to use the sensors and the image data in combination.

While an example in which five separating members are installed has been described in the aforementioned second embodiment, it is only necessary that at least two separating members are installed along the direction perpendicular to the transfer paper conveying direction. Moreover, the separating members may not be adjacent to one another in the direction perpendicular to the transfer paper conveying direction.

While an example which makes use of the deflection sensors for detecting the deflections of the transfer paper has been described in the aforementioned second embodiment, the technology of the present disclosure is not limited thereto. For example, it may be possible to use sensors for detecting the conveying speed of the transfer paper or sensors for detecting the oblique motion of the transfer paper.

What is claimed is:

1. An image forming device, comprising:

an image carrier having a surface on which a toner image is formed;

an intermediate transfer body to which the toner image formed on the image carrier is firstly transferred;

a secondary transfer member arranged to make contact with the intermediate transfer body and configured to secondarily transfer the toner image transferred to the intermediate transfer body, to a recording medium;

separating members arranged at a downstream side of a nip portion between the intermediate transfer body and the secondary transfer member in a recording medium conveying direction and configured to separate the recording medium from the intermediate transfer body;

a power supply circuit configured to apply bias voltages to the separating members; and sensors arranged at an upstream side of the nip portion in the recording medium conveying direction and configured to detect a toner amount transferred to the intermediate transfer body, wherein the separating members are configured to separate the recording medium from the intermediate transfer body when the bias voltages are applied to the separating members, the separating members including two or more separating members installed along a direction perpendicular to the recording medium conveying direction, the sensors include two or more sensors installed along the direction perpendicular to the recording medium conveying direction, the bias voltages are applied to the separating members independently of each other depending on a toner amount distribution of the toner image transferred to the recording medium, in the direction perpendicular to the recording medium conveying direction, and the bias voltages applied to the separating members are controlled depending on outputs of the sensors so as to restrain a deflection of the recording medium toward the intermediate transfer body and the secondary transfer member due to the toner amount distribution in the direction perpendicular to the recording medium conveying direction.

2. The device of claim 1, wherein the sensors are configured to detect a toner concentration of the toner image, and the toner amount is calculated based on detection results of the sensors.

3. The device of claim 1, wherein the sensors are concentration sensors configured to perform concentration correction or color deviation correction with respect to the toner image transferred to the intermediate transfer body.

* * * * *